US010584522B2

(12) United States Patent
Rucha

(10) Patent No.: US 10,584,522 B2
(45) Date of Patent: Mar. 10, 2020

(54) ARRESTING SYSTEM, ESPECIALLY FOR A VEHICLE DOOR

(71) Applicant: HCS-InTec Germany GmbH, Iserlohn (DE)

(72) Inventor: Christian Rucha, Iserlohn (DE)

(73) Assignee: HCS-INTEC GERMANY GMBH, Iserlohn (DE)

( * ) Notice: Subject to any disclaimer, the term of this patent is extended or adjusted under 35 U.S.C. 154(b) by 208 days.

(21) Appl. No.: 15/643,219

(22) Filed: Jul. 6, 2017

(65) Prior Publication Data

US 2018/0010372 A1 Jan. 11, 2018

(30) Foreign Application Priority Data

Jul. 6, 2016 (DE) ..... 10 2016 112 353

(51) Int. Cl.
*E05C 17/22* (2006.01)
*E05F 15/60* (2015.01)
(Continued)

(52) U.S. Cl.
CPC ..... *E05C 17/006* (2013.01); *E05C 17/003* (2013.01); *E05C 17/203* (2013.01);
(Continued)

(58) Field of Classification Search
CPC ..... E05C 17/20; E05C 17/22; E05C 17/203; F16D 2121/24; F16D 63/008; E05B 51/02; E05D 17/00; E05D 17/20; E05F 1/1041; E05F 1/105; E05F 3/16; E05F 3/20; E05F 3/222; E05F 3/22
(Continued)

(56) References Cited

U.S. PATENT DOCUMENTS 5,684,470 A * 11/1997 DeLand ..... B60J 5/06 340/10.5
6,065,185 A * 5/2000 Breed ..... E05C 17/203 16/337
(Continued)

FOREIGN PATENT DOCUMENTS

DE 4207706 A1 9/1993
DE 102010031856 A1 1/2012
(Continued)

OTHER PUBLICATIONS

Jun. 9, 2017, DE correspondence issued for related DE application No. 102016112353.6.

*Primary Examiner* — Emily M Morgan
(74) *Attorney, Agent, or Firm* — Young & Thompson

(57) ABSTRACT

Disclosed is an arresting system for arresting a swivel motion between two swivel-mounted elements, including a brake rod connected to the first element, an arresting device on the second element with a housing, through which the brake rod extends, in which case the arresting device has a drive and at least one brake-shoe element that can be moved via the drive relative to the brake rod. The brake-shoe element is inside the housing and engageable with the brake rod upon exertion of a braking force. Included are a sensor, and an electronic device controlling braking force exerted by the brake-shoe element on the brake rod depending on the signals from the sensor. The drive is an electric motor driving in rotation an actuation element that, to produce the relative motion between the brake-shoe element and the brake rod, has an actuation cam acting on the brake-shoe element.

13 Claims, 18 Drawing Sheets

(51) Int. Cl.

| | |
|---|---|
| ***E05C 17/00*** | (2006.01) |
| ***E05C 17/20*** | (2006.01) |
| ***E05F 5/02*** | (2006.01) |
| ***E05F 5/06*** | (2006.01) |
| *E05B 81/06* | (2014.01) |
| *E05B 81/70* | (2014.01) |

(52) U.S. Cl.
CPC ..... *E05C 17/22* (2013.01); *E05F 5/025* (2013.01); *E05F 5/06* (2013.01); *E05B 81/06* (2013.01); *E05B 81/70* (2013.01); *E05Y 2900/531* (2013.01)

(58) Field of Classification Search
USPC ..... 296/146.4; 49/138, 333, 334, 335
See application file for complete search history.

(56) References Cited

U.S. PATENT DOCUMENTS

| | | | | |
|---|---|---|---|---|
| 6,928,694 | B2 * | 8/2005 | Breed | E05C 17/203 16/82 |
| 7,076,833 | B2 * | 7/2006 | Murayama | E05C 17/203 16/82 |
| 7,280,035 | B2 * | 10/2007 | McLain | B60R 13/043 340/435 |
| 9,777,528 | B2 * | 10/2017 | Elie | E05F 15/41 |
| 9,797,178 | B2 * | 10/2017 | Elie | E05F 15/42 |
| 10,151,132 | B2 * | 12/2018 | Elie | E05F 15/60 |
| 10,161,175 | B2 * | 12/2018 | Elie | E05F 15/40 |
| 2008/0143139 | A1 * | 6/2008 | Bauer | E05C 17/00 296/146.1 |
| 2016/0010379 | A1 * | 1/2016 | Sauerwein | E05F 5/00 701/49 |
| 2017/0260792 | A1 * | 9/2017 | Torres Fernandez | E05F 15/40 |
| 2018/0100334 | A1 * | 4/2018 | Kirchhoff | E05B 51/02 |
| 2018/0155968 | A1 * | 6/2018 | Miu | E05F 15/622 |
| 2018/0313123 | A1 * | 11/2018 | Kenyon | E05D 11/087 |

FOREIGN PATENT DOCUMENTS

| | | | | |
|---|---|---|---|---|
| DE | 102013014845 | A1 | 3/2015 | |
| EP | 0899403 | A1 * | 3/1999 | E05C 17/20 |
| EP | 0911471 | A2 | 4/1999 | |

* cited by examiner

ARRESTING SYSTEM, ESPECIALLY FOR A VEHICLE DOOR

BACKGROUND OF THE INVENTION

Field of the Invention

This invention pertains to an arresting system for halting a swiveling motion between two swivel-mounted elements, comprising a brake rod that is connected to the first element, an arresting device that is arranged in the second element, with a housing through which the brake rod extends, in which case the arresting device has a drive and at least one brake-shoe element that is able to move relative to the brake rod via the drive, where said brake-shoe element is arranged inside the housing and can be activated with the brake rod upon exertion of a braking force, at least one sensor, and an electronic control device for adjusting the level of the braking force exerted by the at least one brake-shoe element on the brake rod as a function of signals from the at least one sensor.

Description of the Related Art

Arresting systems of the type indicated above are known in various implementations in the state of the art. In motor-vehicle manufacturing, they are mainly used to ensure continuous arresting of a vehicle door mounted on a vehicle frame at various swivel positions. Thus, for example, DE 10 2013 014 845 A1 discloses an arresting system with an arresting device attached to a vehicle door, where said device has a housing in which two brake-shoe elements facing one another are accommodated. Between them, the brake-shoe elements hold a brake rod that is mounted on the vehicle frame and that extends through the housing. In this case, they are prestressed by means of cup springs in the direction of the brake rod in such a way that they exert a preset braking force on the brake rod. At least one of the brake shoes is attached on an end face of an actuation element that faces it. The other end face of the actuation element faces toward an electromagnet of the arresting device, in which case a preset air gap is arranged between the actuation element and the electromagnet. Then, the electromagnet is in the electrically activated state, the electromagnet attracts the actuation element and with it draws the brake shoe attached thereto back against the force of the cup springs in such a way that the braking force exerted on the brake rod is reduced or eliminated. The preferred sensor is an acceleration sensor that is built into the vehicle door and that collects the current acceleration of the swivel motion of the vehicle door. The acceleration values collected by the acceleration sensor are integrated over time, and then the resulting velocity values are fed to an electronic control device that is set up in such a way that the energization of the electromagnet is reduced or eliminated as soon as the swivel velocity is close to or equal to zero. Accordingly, the swivel motion is halted, and the vehicle door is stopped as soon as a person opening the vehicle door halts the opening motion. According to an improved implementation, the electronic control device disclosed in DE 10 2013 014 845 A1 can also be equipped to be "smart," such that it can distinguish defined unusual motion patterns, such as, for example, an impact motion caused by a wind gust or something similar from a regular door-opening motion that is intentionally initiated by a person in order to avoid accidents. Furthermore, other data, such as, for example, the condition, the position, and/or the inherent acceleration of the vehicle or vehicle frame, can also be used to adjust the control.

A drawback of the arresting system described in DE 10 2013 014 845 A1 lies in the fact that the electromagnet operates in only one direction. Accordingly, the maximum braking force that is exerted on the brake rod is defined solely by the force of the cup springs and cannot be amplified by the electromagnet. Another drawback lies in the fact that the electromagnet has to have a large inherent weight and large dimensions in order to achieve the desired forces, not a desirable characteristic. Moreover, the air gap between the electromagnet and the actuation element has to be set very precisely in order to ensure that the electromagnet will function fully. This requires a very high degree of manufacturing precision, i.e., high cost. In addition, a small air gap is also associated with high susceptibility to dust, oil, or water that may be present on the brake rod. A further drawback lies in the fact that the position of the electromagnet is preset by the direction of motion of the brake-shoe element, and this makes it more difficult to adapt the design of the mechanism of the arresting device to the available installation space since design freedom is heavily restricted.

SUMMARY OF THE INVENTION

Starting from this state of the art, an object of this invention is to produce a cost-effective arresting system of the above-mentioned type with an alternative structure that requires little installation space, can be flexibly adapted to existing installation space, and permanently ensures reliable operation.

To accomplish this objective, this invention calls for an arresting system of the above-mentioned type that is characterized by the fact that the drive is an electric motor that directly or indirectly drives an actuation element in rotation where, in order to create the relative motion between the brake-shoe element and the brake rod, said actuation element is equipped with at least one actuation cam that acts directly or indirectly on the at least one brake-shoe element. An important advantage of this implementation according to the invention lies in the fact that the use of an electric motor in conjunction with an actuation element having an actuation cam offers a great deal of design freedom, so that the arresting device can be adapted relatively simply to existing installation space. Moreover, electric motors that are suitable for the application in question have a lower inherent weight and are smaller compared to suitable electromagnets, and therefore the arresting device according to the invention can be designed to be lighter in weight and to have outer dimensions that are suitable for smooth incorporation into a vehicle door. In addition, commercially available electric motors with already-integrated gears can be used, thereby leading to lower cost.

According to a first variant of the braking system according to the invention, the axis of rotation of the actuation element is arranged to be aligned with or parallel to the direction of motion of the brake-shoe element, in which case the at least one actuation cam is located on an end face of the actuation element that points in the direction of the brake-shoe element. Accordingly, the arresting device designed in accordance with the first variant can have an essentially elongated shape.

The at least one actuation cam is preferably designed as a spiral that extends around the axis of rotation of the actuation element and that runs in particular around the axis of rotation once, as depicted and described within the framework of the following specification of a first embodiment of an arresting device according to the invention with reference to FIGS. 2 to 39. In other words, the axial cam height is changed linearly especially in the circumferential direction. Moreover, multiple actuation cams that are designed in particular as two partial spirals apiece can be placed on the end face of the actuation element, as depicted in, for example, FIGS. 45 to 49.

It is advantageous for there to be a transfer plate that is mounted between the actuation element and the at least one brake-shoe element, which is torque-proof and can move up and down within the housing, and that on its end face facing the actuation element is equipped with at least one spiral corresponding to the at least one actuation cam of the actuation element and interlocks therewith, in which case on its opposite end face, the transfer plate preferably has a receiving recess for the at least one brake-shoe element. Because of the transfer plate that is designed in this way, very good surface contact between the actuation element and the transfer plate is achieved regardless of the rotation of the electric motor, thereby making the arresting device highly reliable.

According to a second variant of the arresting device according to the invention, the axis of rotation of the activation element extends transversely and especially vertically with respect to the direction of motion of the at least one brake-shoe element, in which case the at least one actuation cam is located on the outer periphery of the actuation element and is, in particular, a spiral, in which case an actuation cam with a spiral shape is defined in this connection to mean a cam with a cam height that varies especially linearly in the circumferential direction. Overall, the arresting device designed in accordance with the second variant winds up being essentially L-shaped.

Preferably at least one spring element is provided, in particular in the form of a cup spring that prestresses the at least one brake-shoe element in a direction away from the brake rod. Such a spring element ensures that when the electromagnet is in the non-energized state, the at least one brake shoe is disengaged from the brake rod, thereby ensuring that a swivel motion can easily be executed especially in emergency situations.

Compared to the at least one brake-shoe element, another brake-shoe element that is mounted on the housing in a stationary fashion is advantageously arranged in such a way that the brake-shoe elements hold the brake rod between them. The use of two brake-shoe elements ensures a very robust design.

The at least one sensor is preferably designed in such a way that it picks up the velocity and/or acceleration of a swivel motion between the two elements that are swivel-mounted with one another. Suitable sensors are, in particular, accelerometers, rev sensors, gyroscopes, or similar devices.

According to one embodiment of the arresting system according to the invention, the two swivel-mounted elements are a vehicle frame and a vehicle door of a motor vehicle.

At least one additional sensor is preferably provided that is designed in such a way that it picks up objects and/or movements outside of the vehicle in the area of the vehicle door, in which case the at least one additional sensor can be part of an already existing vehicle monitoring system, especially one part of such a vehicle monitoring system that monitors the vehicle environment when pulling into a parking space. At this point, it should be mentioned that the at least one additional sensor can also be a part of a camera monitoring system or can consist of such a system.

The at least one additional sensor is advantageously mounted on the outside of the vehicle door and/or on the end face of the vehicle door. Thus, objects present in the area of the vehicle door as well as objects approaching from the rear can easily be detected.

The arresting device and the electronic control device are preferably designed and set up in such a way that the arresting device does not exert any arresting force on the brake rod when the vehicle door is closed. In this way, if the power supply fails, the vehicle door can be opened easily and fairly effortlessly.

It is advantageous for a closed-state sensor that indicates the closed state of the vehicle door to be provided that sends its signals to the control device.

According to one embodiment of the arresting system according to the invention, the control device is set up in such a way that the braking force exerted by the at least one brake-shoe element on the brake rod is raised to a preset constant braking force as soon as the vehicle door is opened starting from the state in which it is closed. The preset constant braking force is especially selected in such a way that a haptically pleasing opening resistance is created. Moreover, such a preset constant braking force prevents the vehicle door from opening or closing on its own due to gravitational acceleration if the vehicle finds itself on an inclined surface.

BRIEF DESCRIPTION OF THE DRAWINGS

Additional features and advantages of this invention are made clear based on the following description of embodiments of arresting systems according to the invention, with reference to the attached drawings. Here.

DESCRIPTION OF THE PREFERRED EMBODIMENTS

Figure 1:
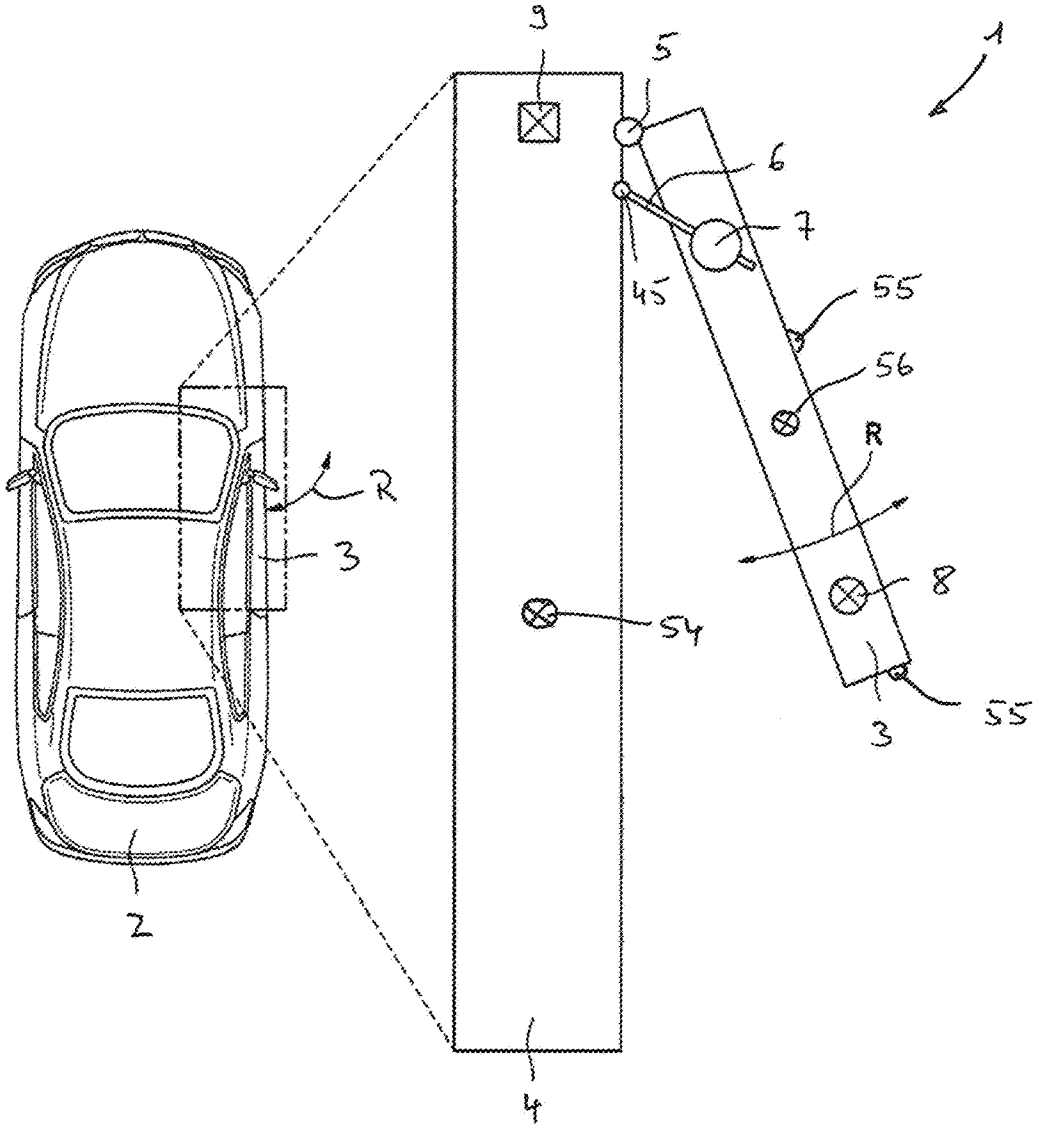
FIG. 1 shows a schematic top view of a vehicle that is equipped with an arresting system in accordance with an embodiment of the present form.

FIG. 1 shows a schematic diagram of an arresting system 1 in accordance with the embodiment of this invention; in this case, the arresting system is integrated into a vehicle 2. The arresting system 1 serves the purpose of arresting the motion of a vehicle door 3 and arresting the vehicle door 3 at any swivel position, in which case the vehicle door 3 is secured to a vehicle frame 4 and is arranged in the direction of a double arrow R to swivel about a vehicle-door swivel axis 5. For this purpose, the arresting system 1 has a brake rod 6 that is swivel-mounted on the vehicle frame 4, an arresting device 7 that is arranged on the vehicle door 3 and that engages with the brake rod 6, at least one sensor 8, which in this case is arranged on the vehicle door 3, and an electronic control device 9 that is designed and set up in such a way that it controls the level of the braking force exerted by the arresting device 7 on the brake rod 6 based on signals from the sensor 8.

Hereinafter, with reference to FIGS. 2 to 39, a description will be given of an arresting device 7 in accordance with a first embodiment of the present invention, as well as the interaction thereof with the brake rod 6.

The arresting device 7 comprises a housing 10 that is depicted in detail in FIGS. 3 to 6 and that has essentially the shape of a hollow square that is open toward the top. On the front and rear of the housing 10, lengthwise openings 10*a* that face one another are provided in the housing 10, and the brake rod 6 is extended through these openings. On the rear of the housing 10, there are attachment flanges 12 that are equipped with threaded holes 11 in the upward and downward directions, and said flanges have the function of securing the housing 10 to the vehicle door 3. On its underside, the housing 10 is closed with a housing base 13, which, on its side that faces toward the inside of the housing 10, defines a recess 14 that in this case is disk-like in shape. Starting from the housing base 13, housing projections 15 extend upward along the four edge areas of the square inner space; said projections, when viewed from above, have an arc-like contour, and in each case one threaded hole 16 extends through them.

The arresting device 7 also comprises two brake-shoe elements 17 that between them accommodate the brake rod 6 that runs through the housing 10. The brake-shoe elements 17, which in this case are identical in design and are depicted in detail in FIGS. 9 and 10, have essentially the shape of a disk and are made of, for example, hard rubber or another material that is suitable as a brake lining. It should, however, be clear that in principle, the brake-shoe elements 17 can also be of any other suitable shape. The lower brake-shoe element 17 is secured in the recess 14 of the housing base 13 and extends upward from said base. The upper brake-shoe element 17 is secured extending downward in a recess 18 that is formed on a lower end face of a transfer plate 19.

As shown in FIGS. 11 to 15, when viewed from above, the transfer plate 19 has an essentially rectangular outer contour that corresponds to the inner contour of the inside space of the housing 10, in which case the corner areas are equipped with recesses 20 whose contours are selected to correspond to the contours of the housing protections 15 of the housing 10. The transfer plate 19 is accommodated inside the housing 10 in such a way that it can move up and down. The top of the transfer plate 19 is designed as a spiral 21 that runs once around a middle blind hole 22 that, starting from the top of the transfer plate 19, extends downward. The cam height h, i.e., the cam height in the axial direction, is correspondingly changed to run linearly in the circumferential direction.

Above the transfer plate 19, there is an essentially disk-shaped actuation element 23 that, as shown in FIGS. 16 to 20, is equipped with a middle pin 24 that extends downward and engages in the blind hole 22 of the transfer plate 19. On its lower end face pointing toward the transfer plate 19, the actuation element 23 is equipped with an actuation cam 25 that, corresponding to the spiral 21 of the transfer plate 19, is designed as a spiral and is contiguous thereto. On the upper end face, the actuation element 23 is equipped with a middle connection recess 26 that is designed as a non-round shape. The diameter of the actuation element 23 is selected in such a way that it can be rotated freely around its axis of rotation.

A housing cover 27, which is shown in detail in FIGS. 21 to 24, is mounted on the actuation element 23, where said housing cover closes the housing 10 from above. The housing cover 27 is equipped on its upper side with four through holes 28 that are arranged in the corner areas, and the hole pattern of these four holes coincides with that of the threaded holes 16 of the housing 10. Accordingly, the housing cover 27, an electric motor 31, and the housing 10 are screwed together by means of fastening screws, not shown in greater detail. On the upper side of the housing cover 27, there is a housing-cover opening 29 in the middle, and the connection recess 26 of the actuation element 23 is accessible from the outside through said opening. In the housing cover 27, four additional through holes 30 are arranged evenly spaced around the housing-cover opening 29.

Figure 25:
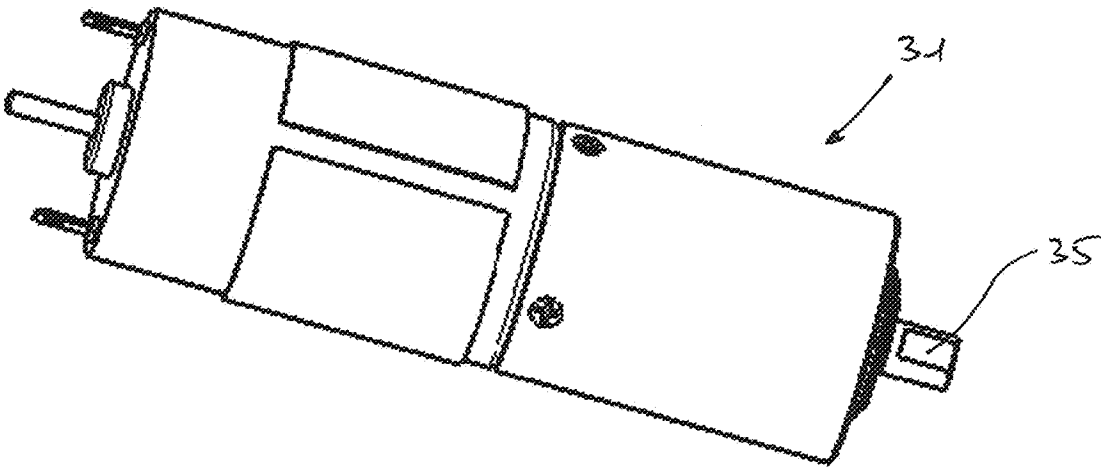
FIG. 25 shows a perspective depiction of a motor with integrated gears of the arresting device depicted in FIG. 2.
Figure 26:
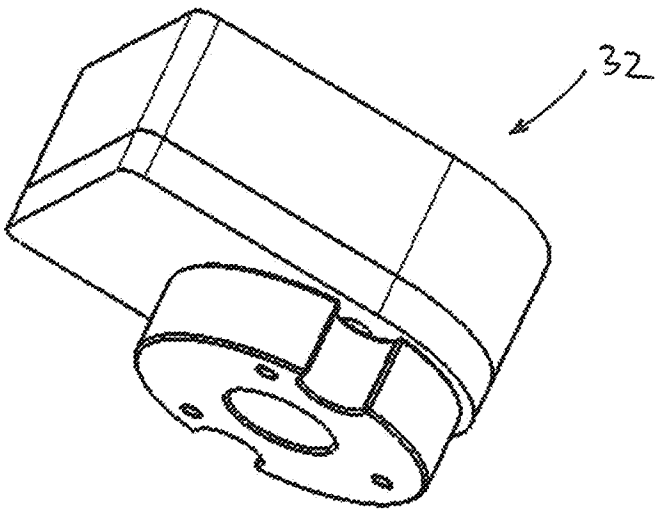
FIG. 26 shows a perspective view of an encoder of the arresting device depicted in FIG. 2.

An electric motor 31, which in this case has integrated gears and an on-board encoder 32 as shown in FIGS. 25 and 26, is secured to the housing 10 via the housing cover 27. For this purpose, on its end face that points toward the housing cover 27, the electric motor 31 is equipped with four holes 33, whose hole pattern coincides with that of the through holes 30, in which case attachment is done by means of fastening screws 34. A drive shaft 35 of the gears, whose contour is adapted to the contour of the connection recess 26 of the actuation element 23, engages in the connection recess 26, so that the gears and actuation element 23 are connected together in a torque-proof manner by form fit.

Figure 27:
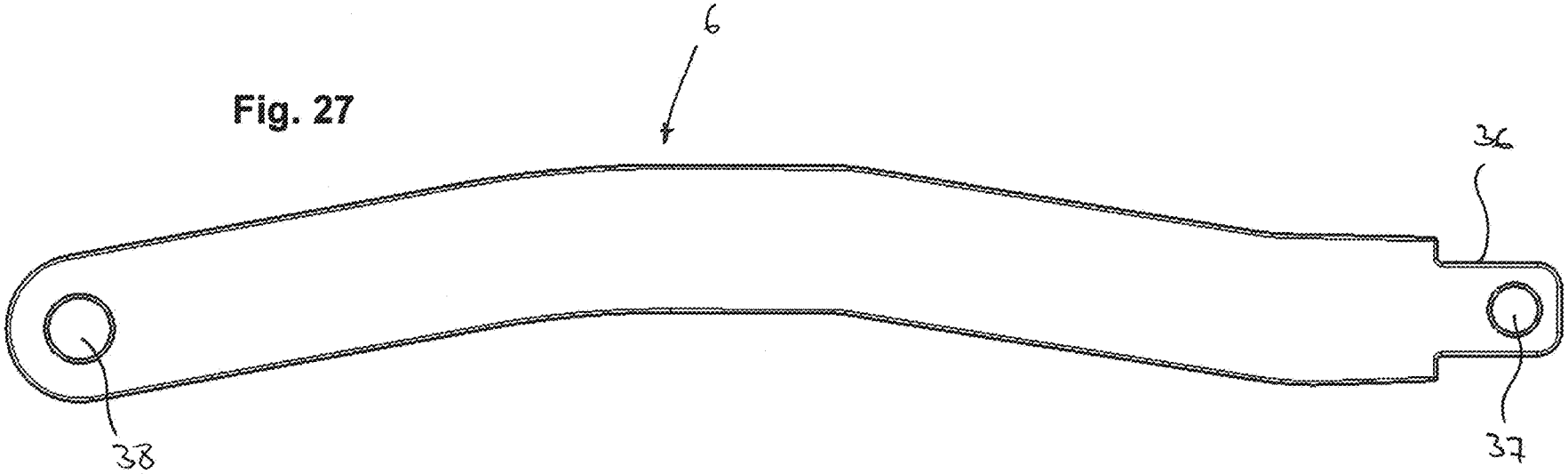
FIG. 27 shows a top view of a brake rod of the arresting device depicted in FIG. 2.
Figure 28:
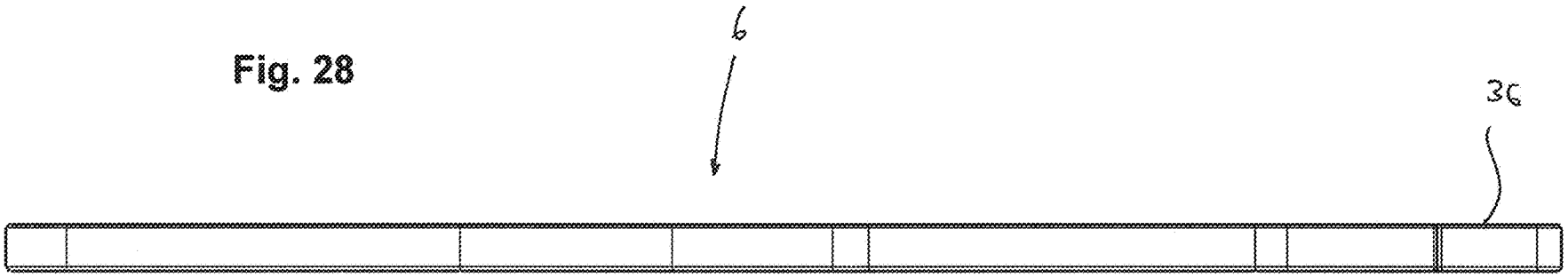
FIG. 28 shows a side view of the arresting device depicted in FIG. 27.
Figure 29:
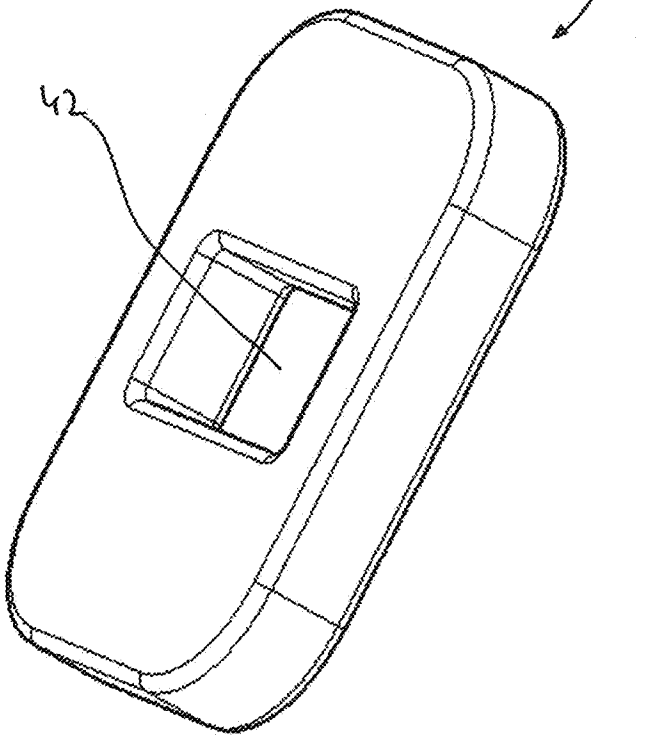
FIG. 29 shows a perspective view of a strike element of the arresting device depicted in FIG. 2.
Figure 31:
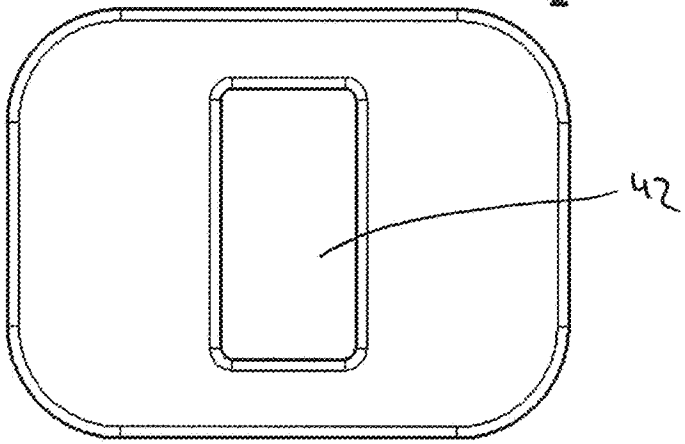
FIG. 31 shows a top view of the strike element depicted in FIG. 29.
Figure 30:
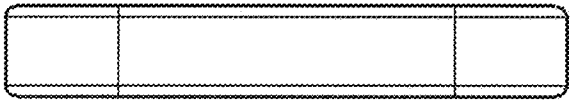
FIG. 30 shows a side view of the strike element depicted in FIG. 29.
Figure 32:
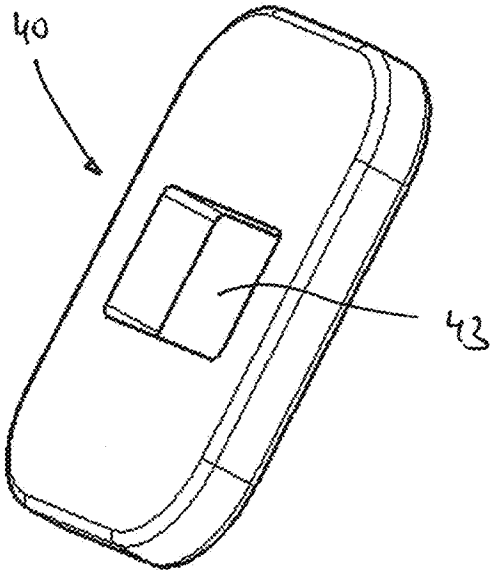
FIG. 32 shows a perspective view of a strike plate of the arresting device depicted in FIG. 2.
Figure 34:
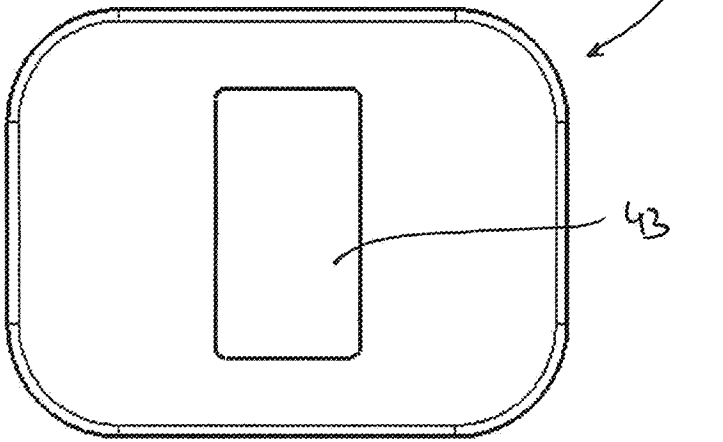
FIG. 34 shows a top view of the strike plate depicted in FIG. 32.
Figure 33:
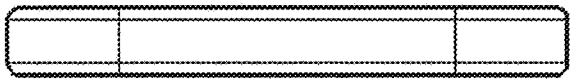
FIG. 33 shows a side view of the strike plate depicted in FIG. 32.
Figure 35:
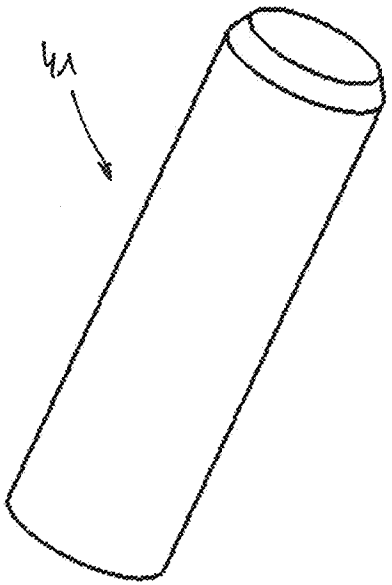
FIG. 35 shows a perspective view of a bolt from the arresting device depicted in FIG. 2.
Figure 36:
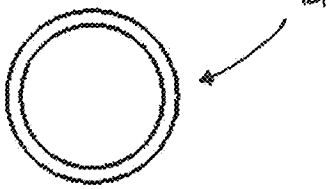
FIG. 36 shows a top view of the bolt depicted in FIG. 35.
Figure 37:
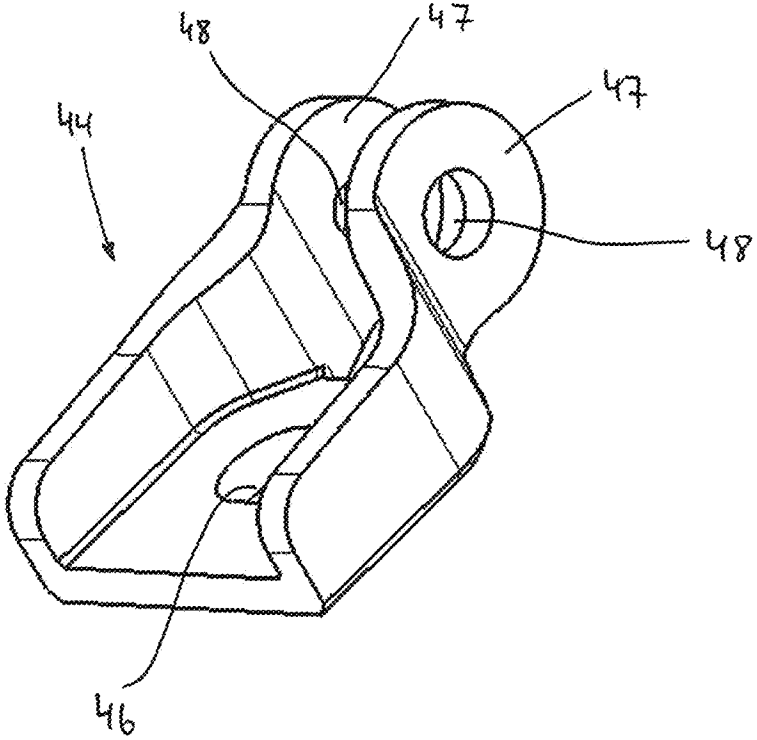
FIG. 37 shows a perspective view of a holding bracket of the arresting device depicted in FIG. 2.
Figure 39:
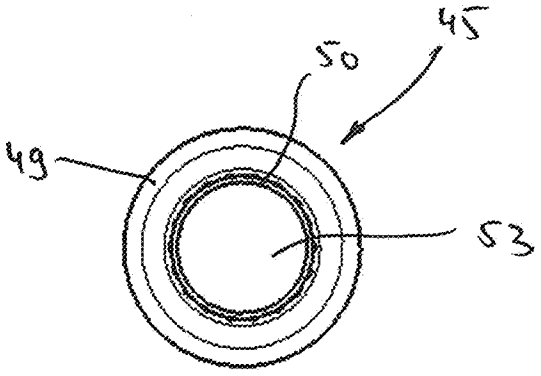
FIG. 39 shows a bottom view of the fastening pin depicted in FIG. 38.
Figure 38:
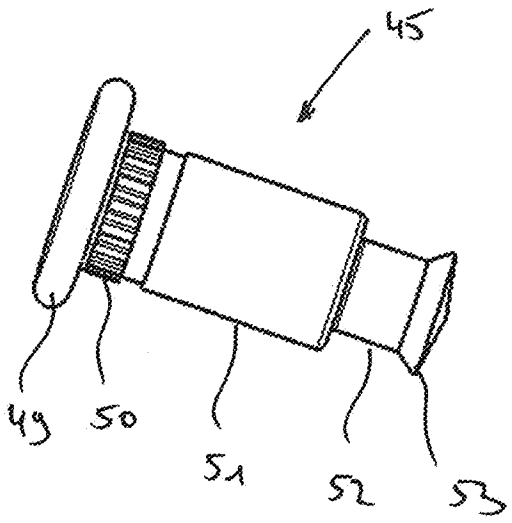
FIG. 38 shows a perspective view of a fastening pin of the arresting device depicted in FIG. 2.

The brake rod 6 depicted in detail in FIGS. 27 and 28 is made of flat metal and in this case has a corrugated shape. At its free end, an upward-pointing section 36 of reduced width is formed in whose end area there is a through hole 37. At its opposite connecting end, the brake rod 6 is rounded off and is also equipped with a through hole 38. A strike element 39 and a strike plate 40 are mounted on the free end of the brake rod 6, and said strike element and strike plate are secured in place by a bolt 41 that is secured in the through hole 37 of the brake rod 6; see also FIGS. 29 to 36. The strike element 39 and the strike plate 40 are of essentially the same dimensions. The strike element 39 is made of rubber and is equipped with a rectangular through opening 42. The strike plate 40 is made of metal or a high-strength hard plastic and also has a through opening 43 that is likewise rectangular in shape. At the connecting end of the brake rod 6, there is a curved sheet-metal holding bracket 44 that is secured via a fastening pin 45 that is able to rotate in the through hole 38; see also FIGS. 37 to 39. To attach it to the vehicle frame 4, the holding bracket 44 is equipped with a hole 46 through which a fastening screw can be run. To secure the holding bracket 44 to the brake rod 6, the holding bracket 4 [translator's note: should be "44"] has two fixing clips 47 that face one another and that are equipped with receiving holes 48 that are oriented in an aligned manner with one another and through which the fastening pin 45 extends. The fastening pin 45 is solidly connected to the holding bracket 44. For this purpose, starting from one of its free ends, the fastening pin 45 has a wraparound flange 49, a knurled cylindrical section 50, whose purpose is to secure the fastening pin 45 in the first receiving hole 48 of the holding bracket 44, a smooth cylindrical section 51, whose diameter is slightly smaller than the diameter of the through hole 38 of the brake rod 6, a smaller-diameter cylindrical section 52 that extends through the second receiving hole 48 of the brake rod 6, and a wraparound projection 53 at the other free end of the fastening pin 45.

Figure 2:
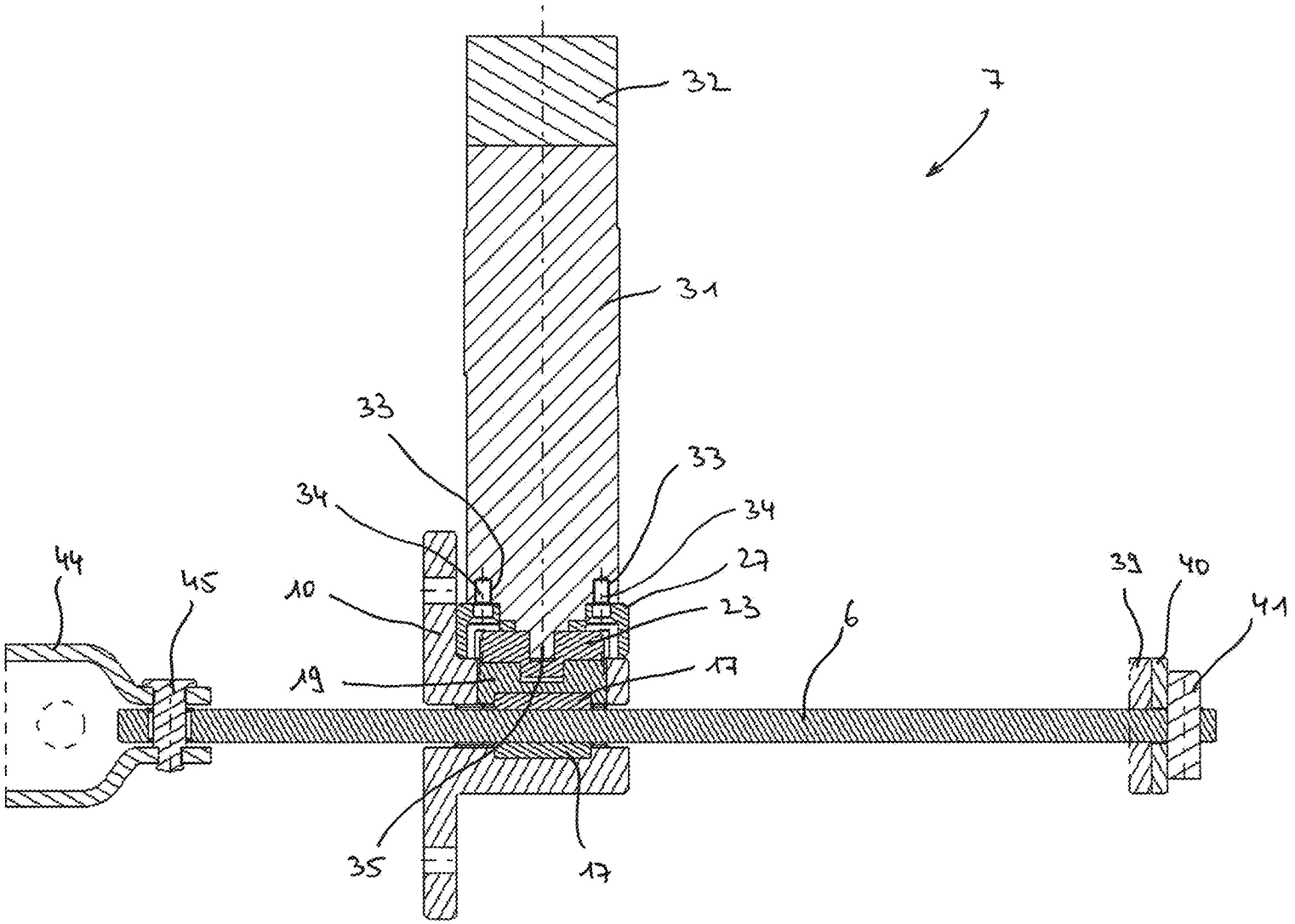
FIG. 2 shows a cutaway side view of a first embodiment of an arresting device of the arresting system depicted in FIG. 1.
Figure 3:
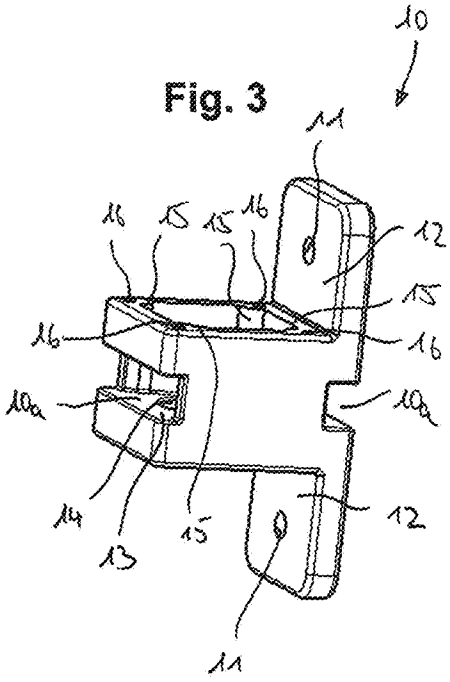
FIG. 3 shows a perspective depiction of a housing of the arresting device shown in FIG. 2.
Figure 8:
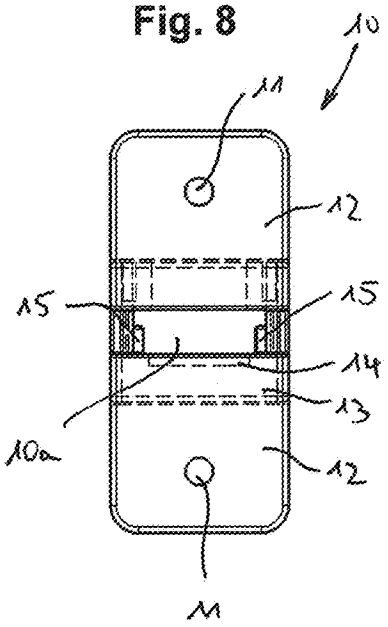
FIG. 8 shows a front view of the housing depicted in FIG. 3.
Figure 5:
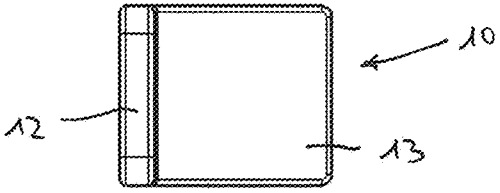
FIG. 5 shows a bottom view of the housing depicted in FIG. 3.
Figure 4:
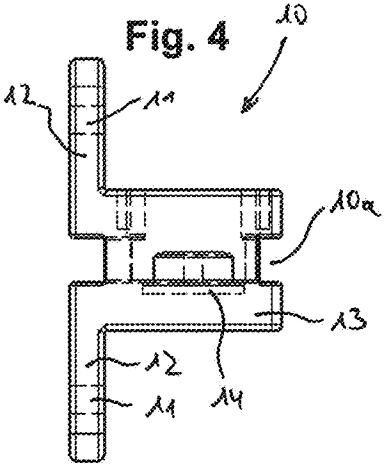
FIG. 4 shows a partially transparent side view of the housing depicted in FIG. 3.
Figure 6:
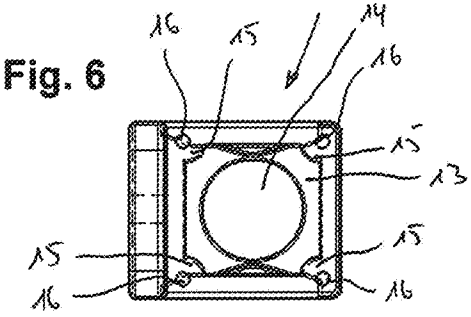
FIG. 6 shows a top view of the housing depicted in FIG. 3.
Figure 7:
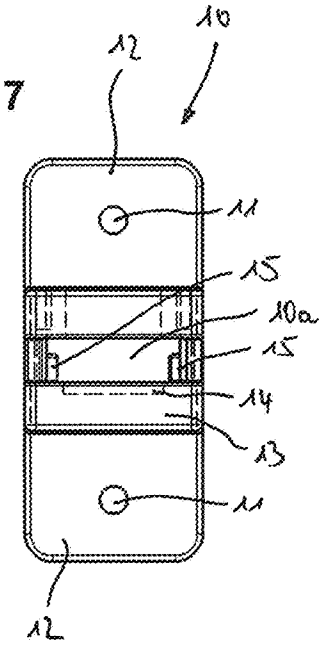
FIG. 7 shows a rear view of the housing depicted in FIG. 3.
Figure 10:
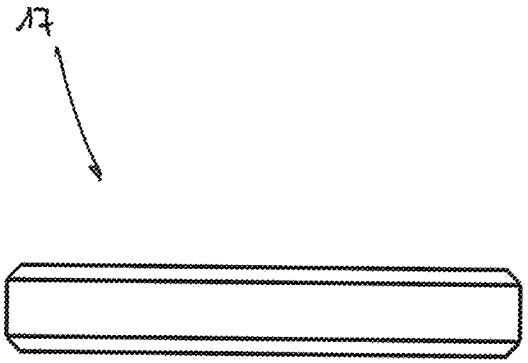
FIG. 10 shows a side view of the brake-shoe element depicted in FIG. 9.
Figure 9:
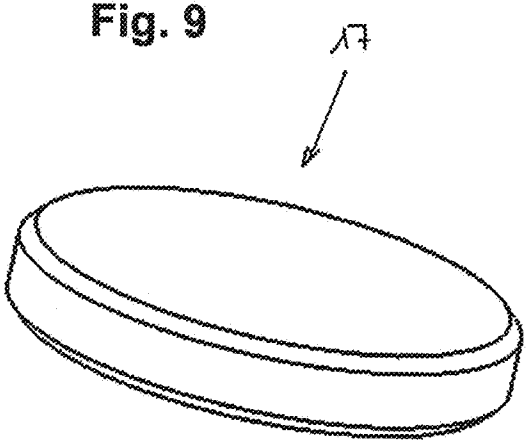
FIG. 9 shows a perspective view of a brake-shoe element of the arresting device depicted in FIG. 2.
Figure 11:
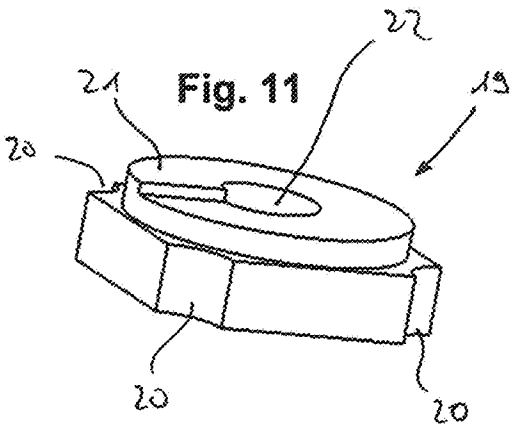
FIG. 11 shows a perspective view of a transfer plate of the arresting device depicted in FIG. 2.
Figure 12:
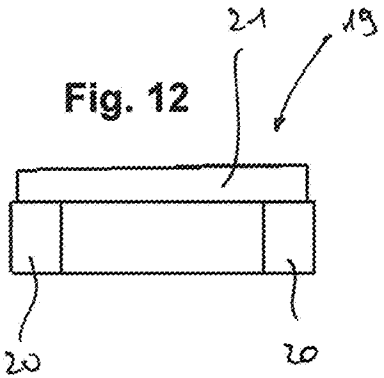
FIG. 12 shows a first side view of the transfer plate depicted in FIG. 11.
Figure 15:
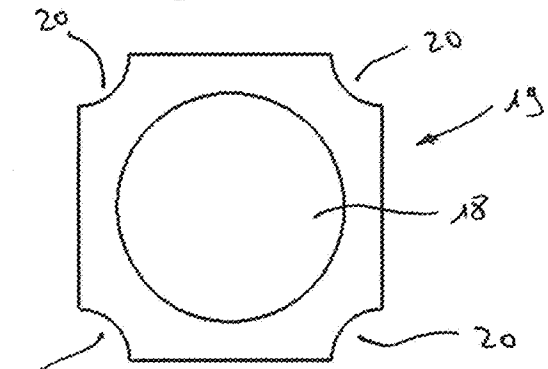
FIG. 15 shows a bottom view of the transfer plate depicted in FIG. 11.
Figure 13:
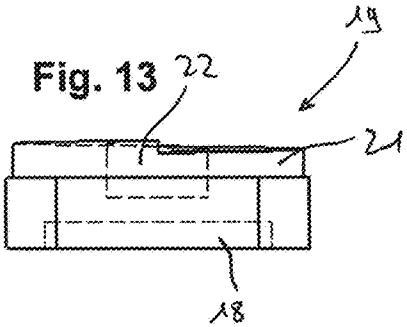
FIG. 13 shows a partially transparent second side view of the transfer plate depicted in FIG. 11.
Figure 14:
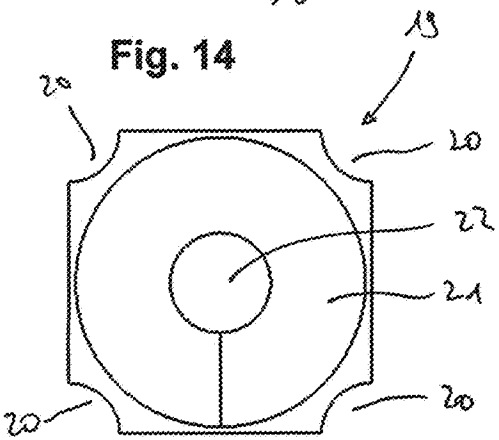
FIG. 14 shows a top view of the transfer plate depicted in FIG. 11.
Figure 16:
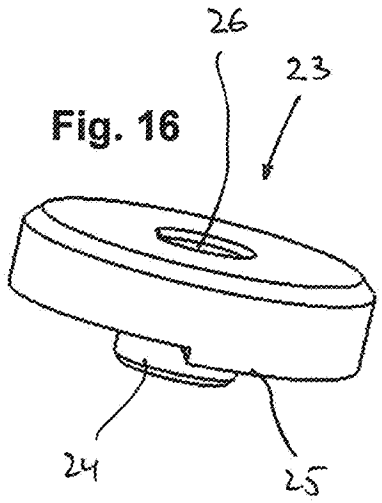
FIG. 16 shows a perspective view of an actuation element of the arresting device depicted in FIG. 2.
Figure 17:
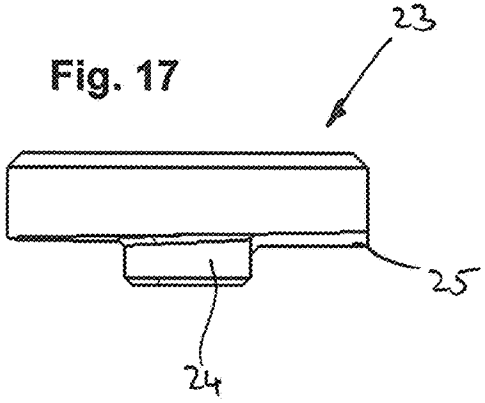
FIG. 17 shows a first side view of the actuation element depicted in FIG. 16.
Figure 20:
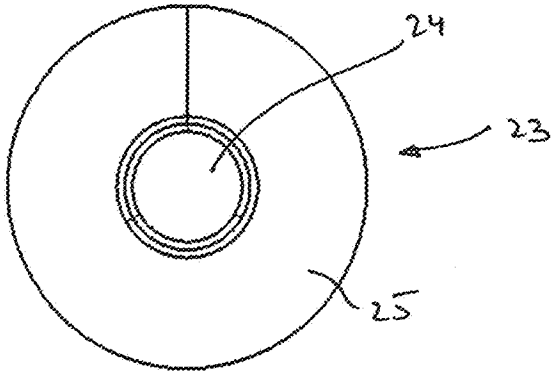
FIG. 20 shows a bottom view of the actuation element depicted in FIG. 16.
Figure 18:
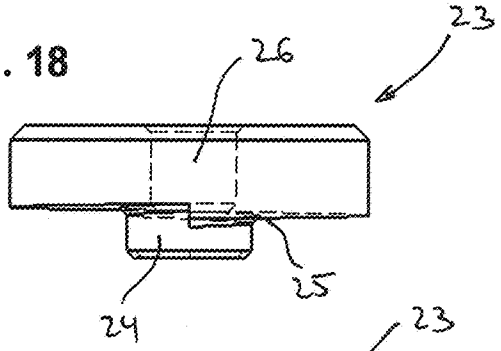
FIG. 18 shows a second side view of the actuation element depicted in FIG. 16.
Figure 19:
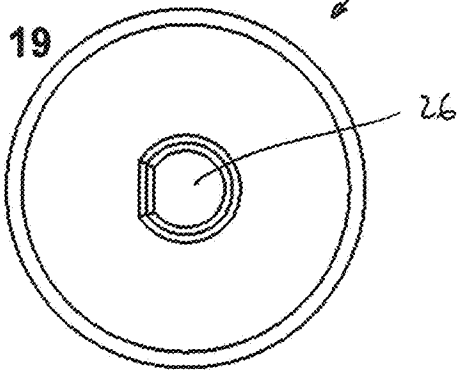
FIG. 19 shows a top view of the actuation element depicted in FIG. 16.
Figure 21:
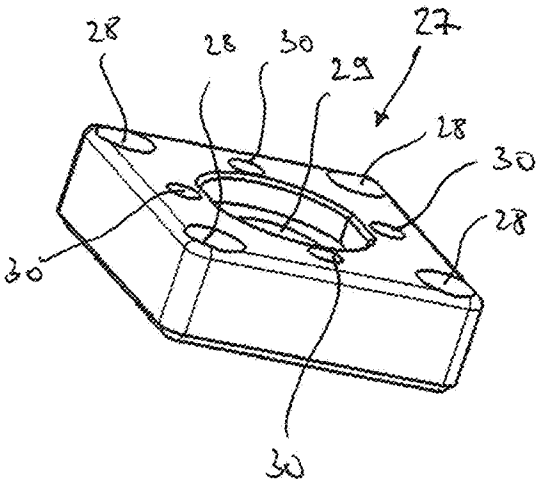
FIG. 21 shows a perspective depiction of a housing cover of the arresting device depicted in FIG. 2.
Figure 22:
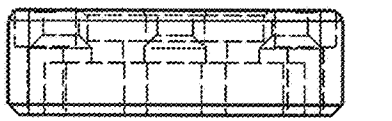
FIG. 22 shows a partially transparent side view of the housing cover depicted in FIG. 21.
Figure 24:
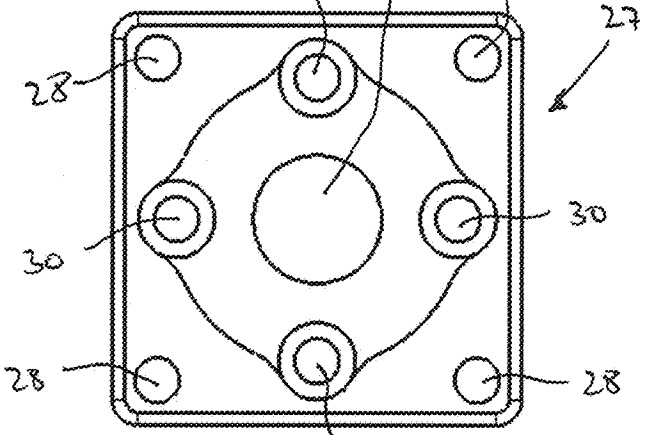
FIG. 24 shows a top view of the housing cover depicted in FIG. 21.
Figure 23:
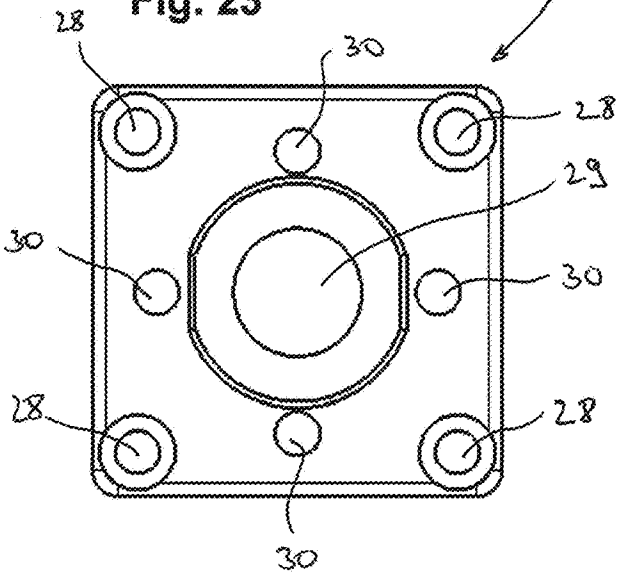
FIG. 23 shows a bottom view of the housing cover depicted in FIG. 21.

In the installed state in accordance with the specification, the arrangement shown in FIG. 2 is connected to the vehicle frame 4 via the holding bracket 44 and to the vehicle door 3 via the attachment flange 12 of the housing 10. In this case, the fastening pin 45 extends parallel to the vehicle-door swivel axis 5, so that the brake rod 6 moves back and forth within the framework of a swivel motion of the vehicle door 3 inside the housing 10, and here the strike element 39 and the strike plate 40 serve to limit the swivel motion. These parts thus define the maximum swivel angle of the vehicle door 3.

If the pinion shaft 35 of the electric motor 31 or of the gears is in a first position in which the actuation element 23 does not exert any pressure on the transfer plate 19, the brake rod 6 is able to move freely inside the housing 10. If the pinion shaft 35 and with it the actuation element 23 are rotated out of this first position, then the actuation cam 25 of the actuation element 23 will act on the spiral 21 of the transfer plate 19 in such a way that the transfer plate 19, together with the brake-shoe element 17 held thereon, will move in the direction of the brake-shoe element 17 secured to the housing 10. Accordingly, the brake-shoe elements 17 exert on the brake rod 6 a braking force that will oppose any movement of the brake rod 6 inside the housing 10. In this way, the swivel motion of the vehicle door can be halted and can also be arrested in any swivel position.

FIGS. 40 to 49 show an alternative design of the transfer plate 19, on the one hand, and of the actuation element 23, on the other hand. These components differ from the previously depicted and described parts only in that the upper side of the transfer plate 19 is designed as a double spiral 21, where each spiral 21 extends 180° along the middle blind hole 22, and in that, on its lower end face facing toward the transfer plate 19, the actuation element 23 is equipped with two actuation cams 25 that are designed to correspond to the spirals 21 of the transfer plate 19.

Figure 40:
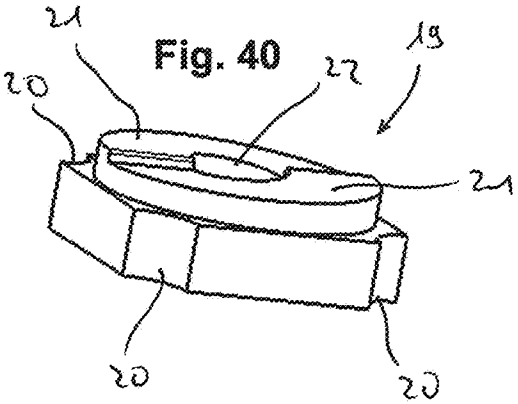
FIG. 40 shows a perspective view of an alternative transfer plate of the arresting device depicted in FIG. 2.
Figure 41:
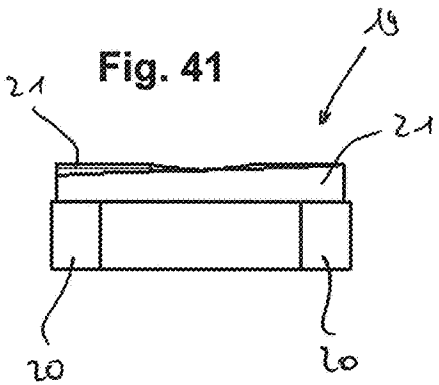
FIG. 41 shows a first side view of the transfer plate depicted in FIG. 40.
Figure 44:
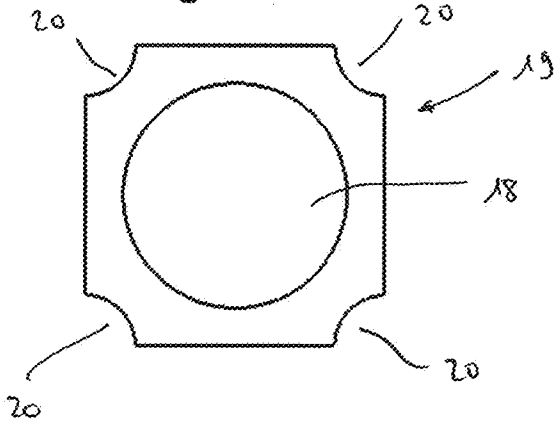
FIG. 44 shows a bottom view of the transfer plate depicted in FIG. 40.
Figure 42:
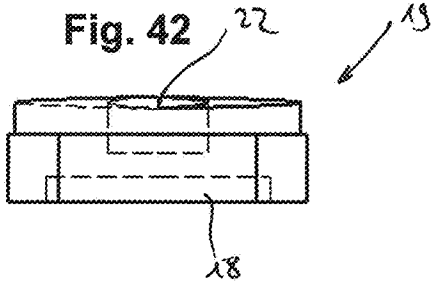
FIG. 42 shows a partially transparent second side view of the transfer plate depicted in FIG. 40.
Figure 43:
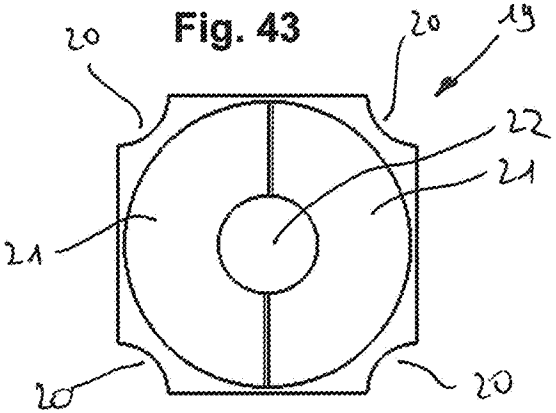
FIG. 43 shows a top view of the transfer plate depicted in FIG. 40.
Figure 45:
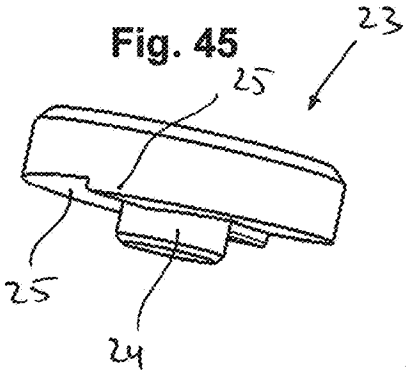
FIG. 45 shows a perspective view of an alternative actuation element of the arresting device depicted in FIG. 2, since it is used together with the transfer plate depicted in FIGS. 40 to 44.
Figure 46:
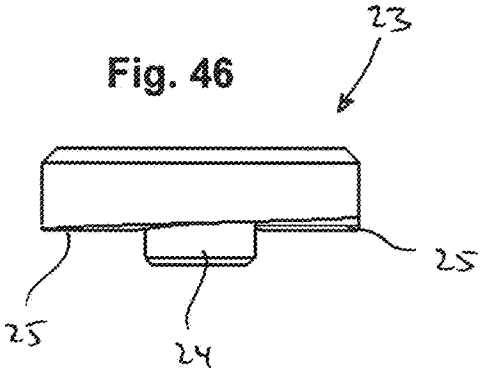
FIG. 46 shows a first side view of the actuation element depicted in FIG. 45.
Figure 49:
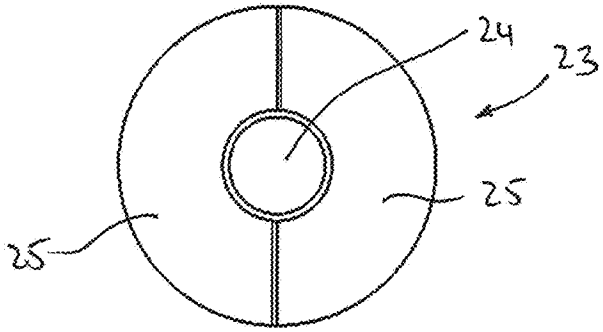
FIG. 49 shows a bottom view of the actuation element depicted in FIG. 45.
Figure 47:
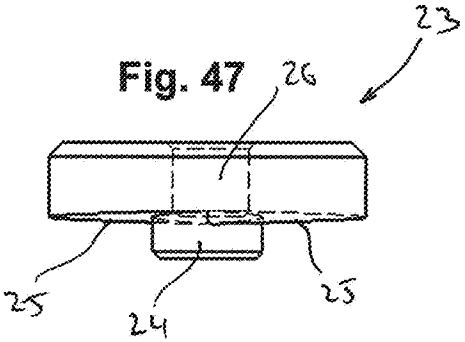
FIG. 47 shows a second side view of the actuation element depicted in FIG. 45.
Figure 48:
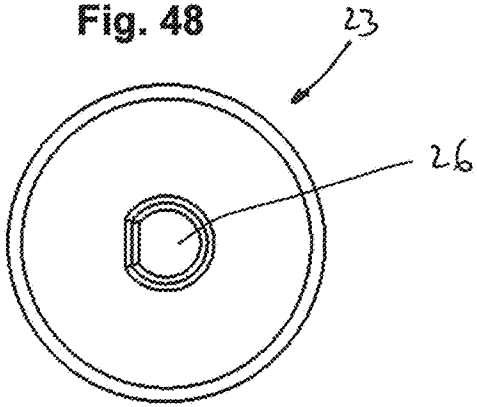
FIG. 48 shows a top view of the actuation element depicted in FIG. 45.
Figure 51:
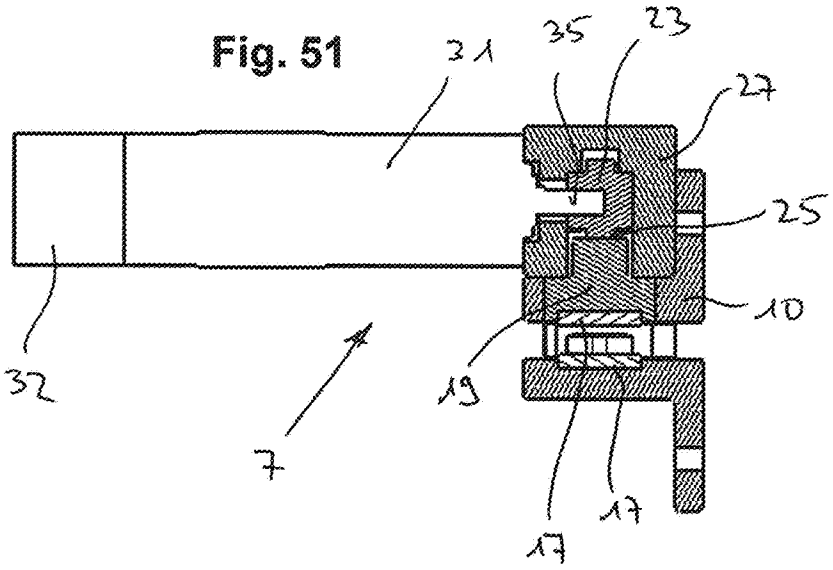
FIG. 51 shows a partial cutaway side view of the arresting device depicted in FIG. 50.
Figure 50:
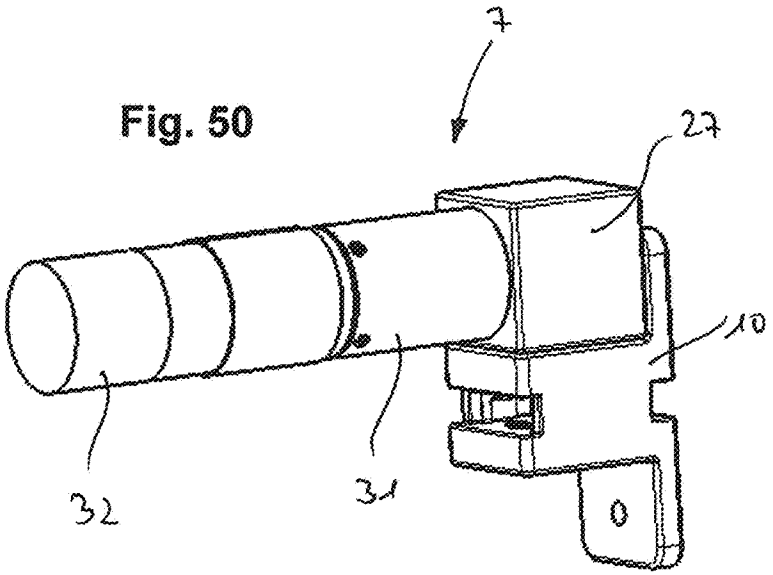
FIG. 50 shows a perspective view of an arresting device according to a second embodiment of this invention.

FIGS. 50 and 51 show an arresting device 1 in accordance with a second embodiment of this invention that, like the above-described arresting device, has a housing 10, two brake-shoe elements 17, a transfer plate 19, an actuation element 23, a housing cover 27, an electric motor 31 with integrated gears, and an encoder 32. The essential difference consists, on the one hand, in that the axis of rotation of the actuation element 23 extends transversely to and primarily vertically to the direction of motion of the movable brake-shoe element 17, where the spiral-shaped actuation cam 25 is mounted on the periphery of the actuation element 23. On the other hand, the end face of the transfer plate 19 that faces toward the actuation element 23 and with which the actuation element 23 is engaged is designed in the same way. Thus, the arresting device 7 depicted in FIGS. 40 and 41 is essentially L-shaped. The shapes of the housing 10 and of the housing cover 27 are adapted accordingly.

Referring again to FIG. 1, the operation of the arresting system 1 according to the invention is described below.

The sensor 8 of the arresting system 1 that is integrated into the vehicle door 3 is primarily an acceleration sensor. To activate the system when the vehicle door 3 of the vehicle 2 standing on a level surface is closed, the sensor 8 is adjusted to zero, so that it receives its starting position, which is stored in the control device 9. The sensor 8 primarily picks up the current acceleration of the vehicle door as it is opened and closed and sends those values to the control device 9.

Based on the signals forwarded by the sensor 8, the control device 9 identifies in advance events that are predefined by software and activates the arresting device 7 in such a way that the device, depending on the nature of the identified event, exerts a predefined and optionally corrected braking force or a braking force calculated by the control device 9 on the basis of the signal(s) received from the sensor 8. Actuation is primarily based on the level of the current that is fed to the electric motor 31. Based on the existing mechanics of the arresting device 7, what motor current will evoke what braking force is known. Based on the acceleration due to gravity, the control device 9 determines, moreover, whether the vehicle 2 is on an inclined surface. If this is the case, this state is taken into account in calculating the braking force, or a braking force that is predefined for the identified event is corrected accordingly.

Based on the acceleration values received from the sensor 8, the control device 9 determines angular velocity by integration and determines the turn angle of the vehicle door 3 by repeated reintegration. If a swivel motion of the vehicle door 3 is halted by the user at, for example, an arbitrary angle, then this event will be picked up by the control device 9 by virtue of the fact that the acceleration, minus the acceleration due to gravity and also the angular velocity, is equal to zero. In this case, the arresting device 7 is prompted to arrest the vehicle door 3. This makes it possible to prevent the vehicle door 3 from being accidentally moved by external influences.

If the user then again moves the vehicle door 3 out of the arrested state, the braking force of the arresting device 7 will act against this motion. Because of the lever that is defined by the distance between the sensor 8 and the arresting device 7 or the vehicle-door swivel axis 5, the vehicle door 3 can be moved elastically despite the fact that the brake is set. This motion is picked up by the control device based on the corresponding acceleration and is treated as an event. If the motion profile (acceleration and angular velocity over time) corresponds to a user profile defined in the control device 9, then the control device 9 will resolve the braking force exerted by the arresting device 7. If, however, the motion profile is a different profile, one that is caused by external influences, such as, for example, a gust of wind, the braking force will then remain unchanged.

Based on the current angle of rotation of the vehicle door 3, the door can be arrested before the maximum angle of rotation that is defined by the strike element 39 or the strike plate 40 is reached. Excessive wear and tear on these components can thus be avoided.

Another sensor that the arresting system 1 can have is a closed-state sensor 54, for example in the form of a limit switch that forwards a signal to the control device 9 as soon as the vehicle door 3 is closed. In this case, the control device 9 is preferably set up in such a way that the braking force of the arresting device 7 is fully unleashed when the vehicle door 3 is closed. This accordingly ensures that, especially in the event of an accident, the vehicle door 3 cannot be prevented from being opened by the arresting device 7. In addition, the control device 9 is advantageously set up in such a way that the arresting device 7 is activated to a small extent as soon as the vehicle door 3 is opened. When the user opens the vehicle door 3, he may perceive a slight preset braking force as very welcome.

Other sensors with which the arresting system 1 can be equipped may include distance sensors 55 that are arranged on the outside of the vehicle door 3 and/or on the end face of the vehicle door 3 and that pick up objects and/or movements outside of the vehicle 2 in the area of the vehicle door 3. Accordingly, an accidental collision with foreign objects when the vehicle door 3 is being opened can be reliably avoided. Thus, the control device 9 can be set up in such a way, for example, that the braking force of the arresting device 7 is built up gradually as soon as the distance between the vehicle door 3 and an object drops below 20 cm, in which case the full braking force will be exerted on the brake rod 6 as soon as a distance of 5 cm from the object is reached, to cite just one example. The distance sensors 55 can be part of an already existing vehicle monitoring system, such as, for example, the kind of system that is used as a parking aid.

There also exists the option of equipping the arresting system 1 with a turn-rate sensor 56 (gyroscope) that picks up the angular velocity of the vehicle door 3. By integration, the control device 9 can determine the angle of rotation, and, by derivation, it can determine acceleration. By sensor fusion with the sensor 8, acceleration, angular velocity, and angle of rotation can then be determined with great precision, thus improving the response of the arresting system 1.

It should also be clear that the above-described arresting system 1 is also able to emit acoustic or optical signals that will warn the user when certain events occur, as is fairly well known in particular from systems used as parking aids.

Although the invention will be illustrated and described in greater detail based on the preferred illustrative embodiment, the invention is not restricted by the examples that are disclosed, and one skilled in the art will be able to derive other variations therefrom without exceeding the scope of protection of the invention.

REFERENCE LIST

1 arresting system
2 vehicle
3 vehicle door
4 vehicle frame
5 vehicle-door axis of rotation
6 brake rod
7 arresting device
8 sensor
9 control device
10 housing
10*a* opening
11 threaded hole
12 fastening flange
13 housing base
14 recess
15 housing projection
16 threaded hole
17 brake-shoe element

18 recess
19 transfer plate
20 recess
21 spiral
22 blind hole
23 actuation element
24 pin
25 actuation cam
26 connection recess
27 housing cover
28 through hole
29 housing cover opening
30 through hole
31 electric motor
32 encoder
33 threaded hole
34 fastening screw
35 drive shaft
36 section
37 through hole
38 through hole
39 strike element
40 strike plate
41 bolt
42 through opening
43 through opening
44 holding bracket
45 fastening pin
46 hole
47 fixing clip
48 receiving hole
49 flange
50 knurled cylindrical section
51 smooth cylindrical section
52 smaller-diameter cylindrical section
53 circumferential projection
54 closed-state sensor
55 motion sensor
56 turn-rate sensor

The invention claimed is:

1. An arresting system (1) for arresting a swivel motion between two swivel-mounted elements (3, 4), comprising:

a brake rod (6) that is connected to the first element (4), an arresting device (7) that is arranged on the second element (3), with a housing (10), through which the brake rod (6) extends, where the arresting device (7) has an electric motor (31) and at least one brake-shoe element (17) that can be moved relative to the brake rod (6) via the electric motor (31), where said brake-shoe element is arranged inside the housing (10) and can be engaged with the brake rod (6) when a braking force is exerted;

at least one sensor (8), and an electronic control device (9) which controls the level of the braking force exerted on the brake rod (6) by the at least one brake-shoe element (17) depending on the signals from the at least one sensor (8), an actuation element (23) having an axis of rotation, wherein the electric motor directly or indirectly drives the actuation element (23) in rotation to create the relative motion between the brake-shoe element (17) and the brake rod (6), wherein the actuation element is equipped with at least one actuation cam (25) that acts on the at least one brake-shoe element (17), wherein the axis of rotation of the actuation element (23) is aligned with or is parallel to the direction of motion of the brake-shoe element (17), and wherein the at least one actuation cam (25) is located on an end face of the actuation element (23) that faces the brake-shoe element (17), wherein the at least one actuation cam (25) is designed as a spiral that extends around the axis of rotation of the actuation element (23), where said spiral rotates around the axis of rotation.

2. The arresting system (1) in accordance with claim 1, wherein between the actuation element (23) and the at least one brake-shoe element (17), there is a transfer plate (19) that can move up and down inside the housing (10);

wherein on a first end face of the transfer plate facing the actuation element (23), said transfer plate is equipped with at least one spiral (21) that corresponds to the at least one actuation cam (25) of the actuation element (23) and is engaged in said actuation element, and wherein the transfer plate (19) has, on its opposing second end face, one receiving recess (18) for the at least one brake-shoe element (17).

3. The arresting system (1) in accordance with claim 1, further comprising a second brake shoe element permanently attached to the housing opposite the at least one brake shoe element, so that the brake rod is between the brake shoe elements.

4. The arresting system (1) in accordance with claim 1, wherein the at least one sensor (8) detects a speed and/or acceleration of a swivel motion between the two swivel-mounted elements.

5. The arresting system (1) in accordance with claim 1, wherein the two swivel-mounted elements are a vehicle frame (4) and a vehicle door (3) of a vehicle (2).

6. The arresting system (1) in accordance with claim 5, wherein at least one additional sensor is provided that detects objects and/or movements outside of the vehicle (2) in the area of the vehicle door (3).

7. The arresting system (1) in accordance with claim 6, wherein the at least one additional sensor is arranged on the outside of the vehicle door (3) or on the end face of the vehicle door (3).

8. The arresting system in accordance with claim 5, wherein the arresting device (7) does not exert any braking force on the brake rod (6) when the vehicle door (3) is in the closed state.

9. The arresting system (1) in accordance with claim 8, wherein a closed-state sensor is provided that indicates the closed state of the vehicle door (3) and that sends its signals to the control device (9).

10. The arresting system (1) in accordance with claim 5, wherein as soon as the vehicle door (3) is opened from its closed state, the braking force exerted by the at least one brake-shoe element (17) on the brake rod (6) is raised to a preset constant braking force.

11. The arresting system of claim 3, wherein said spiral rotates around the axis of rotation once.

12. The arresting system (1) in accordance with claim 6, wherein the at least one additional sensor includes a first sensor arranged on the outside of the vehicle door (3) and a second sensor arranged on the end face of the vehicle door (3).

13. An arresting system (1) for arresting a swivel motion between two swivel-mounted elements (3, 4), comprising:

a brake rod (6) that is connected to the first element (4), an arresting device (7) that is arranged on the second element (3), with a housing (10), through which the brake rod (6) extends, where the arresting device (7) has an electric motor (31) and at least one brake-shoe element (17) that can be moved relative to the brake rod (6) via the electric motor (31), where said brake-shoe element is arranged inside the housing (10) and can be engaged with the brake rod (6) when a braking force is exerted;

at least one sensor (8), and an electronic control device (9) which controls the level of the braking force exerted on the brake rod (6) by the at least one brake-shoe element (17) depending on the signals from the at least one sensor (8), wherein the electric motor (31) that directly or indirectly drives an actuation element (23) in rotation to create the relative motion between the brake-shoe element (17) and the brake rod (6), wherein the actuation element is equipped with at least one actuation cam (25) that acts on the at least one brake-shoe element (17), wherein the axis of rotation of the actuation element (23) runs transversely to the direction of motion of the at least one brake-shoe element (17) and the at least one actuation cam (25) is provided on the outer periphery of the actuation element (23) and is shaped like a spiral.

* * * * *